US006672384B2

(12) United States Patent
Pedersen et al.

(10) Patent No.: US 6,672,384 B2
(45) Date of Patent: Jan. 6, 2004

(54) PLUG-DROPPING CONTAINER FOR RELEASING A PLUG INTO A WELLBORE

(75) Inventors: Gerald Dean Pedersen, Houston, TX (US); David Eugene Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 19 days.

(21) Appl. No.: 10/066,460

(22) Filed: Jan. 31, 2002

(65) Prior Publication Data

US 2003/0141052 A1 Jul. 31, 2003

(51) Int. Cl.[7] ..... E21B 33/13; E21B 33/05
(52) U.S. Cl. ..... 166/75.15; 70/177.4
(58) Field of Search ..... 166/70, 75.15, 166/177.4

(56) References Cited

U.S. PATENT DOCUMENTS

| | | | | |
|---|---|---|---|---|
| 2,630,179 A | | 3/1953 | Brown | 166/14 |
| 3,086,587 A | | 4/1963 | Zandmer et al. | 166/284 |
| 3,444,928 A | | 5/1969 | Pitts | 166/70 |
| 3,971,436 A | * | 7/1976 | Lee | 166/70 |
| 4,164,980 A | * | 8/1979 | Duke | 166/70 |
| 4,427,065 A | * | 1/1984 | Watson | 166/70 |
| 4,491,177 A | | 1/1985 | Baugh | 166/75 R |

(List continued on next page.)

FOREIGN PATENT DOCUMENTS

EP 0 969 183 A2 1/2000 ..... E21B/33/16

OTHER PUBLICATIONS

USSN 10/616, 643, Filed Jul. 10, 2003, Pedersen, et al., "Plug–Dropping Container For Releasing A Plug Into A Wellbore."

USSN 10/208,568, Filed Jul. 30, 2002, Pedersen, et al., "Ball Dropping Assembly."

PCT International Search Report, International Application No. PCT/GB03/00307, dated May 21, 2003.

USSN 10/081,062, Filed Feb. 21, 2002, Pederson, et al. "Ball Dropping Assembly."

Liner Hangers, Bestline Liner Systems, Inc., 2000/2001 General Catalog, Bakersfield, CA, E–mail: bestlinelinersystems.com, 3 Pages.

Cementing Manifold & Wiper Plugs, Applied Technologies, Inc. (ATI), 1 Page.

Liner Hangers, Open Hole Completion Systems, Baker Oil Tools, 6 Pages.

*Primary Examiner*—David Bagnell
*Assistant Examiner*—Brian Halford
(74) *Attorney, Agent, or Firm*—Moser, Patterson & Sheridan, L.L.P.

(57) ABSTRACT

The present invention relates to a plug-dropping container for releasing plugs or other objects into a wellbore during fluid circulation procedures. In one aspect, the plug-dropping container is used as part of a cementing head. The plug-dropping container comprises an elongated housing, and a canister disposed co-axially within the housing. The canister is movable from a lower position to an upper position. In its lower position, a fluid bypass area is defined above the canister. When a dart is retained within the canister, fluid is diverted through the bypass and around the canister within an annular area defined between the canister and the housing. In one aspect, the canister is moved by rotation of a plug-retaining device below the canister. In its plug-retained position, the plug-retaining device is oriented so that the wall of the plug-retaining device is blocking the downward path of the dart. In the plug-released position, the plug-retaining device raises the canister to its upper position, substantially shutting off the bypass. A channel in the plug-retaining device is thus aligned with a channel in the canister for receiving the plug, and for release into the wellbore.

39 Claims, 7 Drawing Sheets

U.S. PATENT DOCUMENTS 4,674,573 A * 6/1987 Bode ..... 166/70
4,782,894 A * 11/1988 LaFleur ..... 166/70
4,917,184 A 4/1990 Freeman et al. ..... 166/285
5,236,035 A 8/1993 Brisco et al. ..... 166/70
5,443,122 A * 8/1995 Brisco ..... 166/70
5,553,667 A * 9/1996 Budde et al. ..... 166/70
5,758,726 A 6/1998 Streich et al. ..... 166/379
5,833,002 A * 11/1998 Holcombe ..... 166/70
5,890,537 A * 4/1999 Lavaure et al. ..... 166/285
5,950,724 A * 9/1999 Giebeler ..... 166/70
5,960,881 A * 10/1999 Allamon et al. ..... 166/70
6,182,752 B1 2/2001 Smith, Jr. et al. ..... 166/70
6,206,095 B1 3/2001 Baugh ..... 166/70
6,220,360 B1 4/2001 Connell et al. ..... 166/373
6,311,711 B1 11/2001 Skoglund ..... 137/2

* cited by examiner

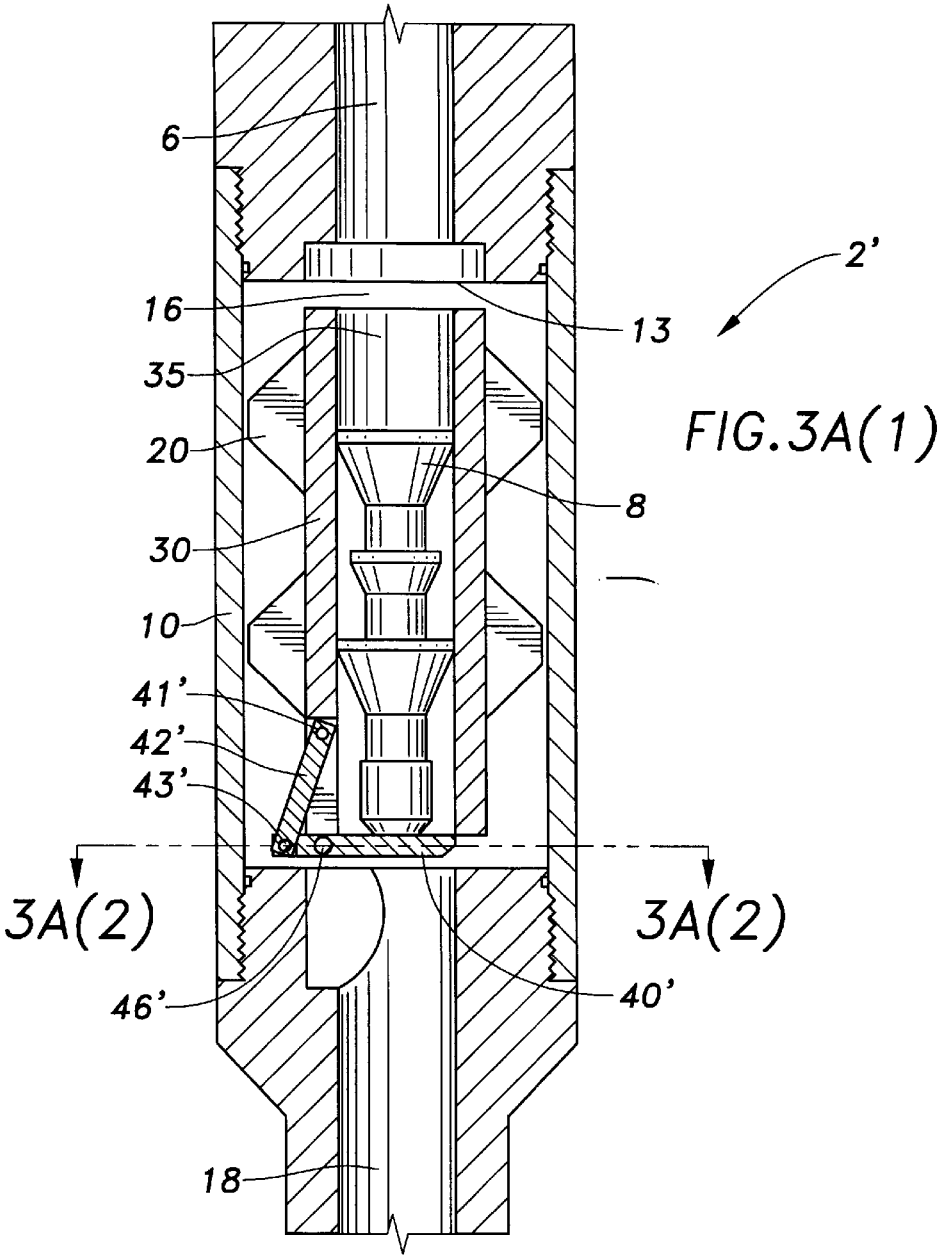
FIG.3A(1)
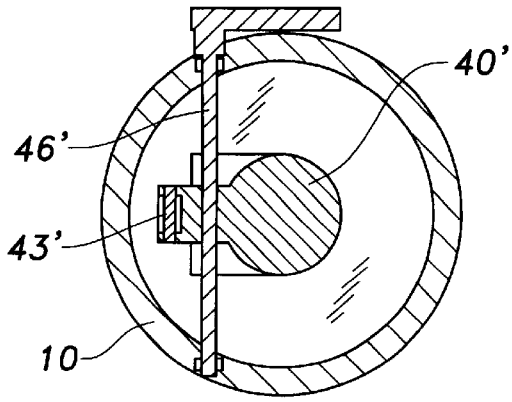
FIG.3A(2)

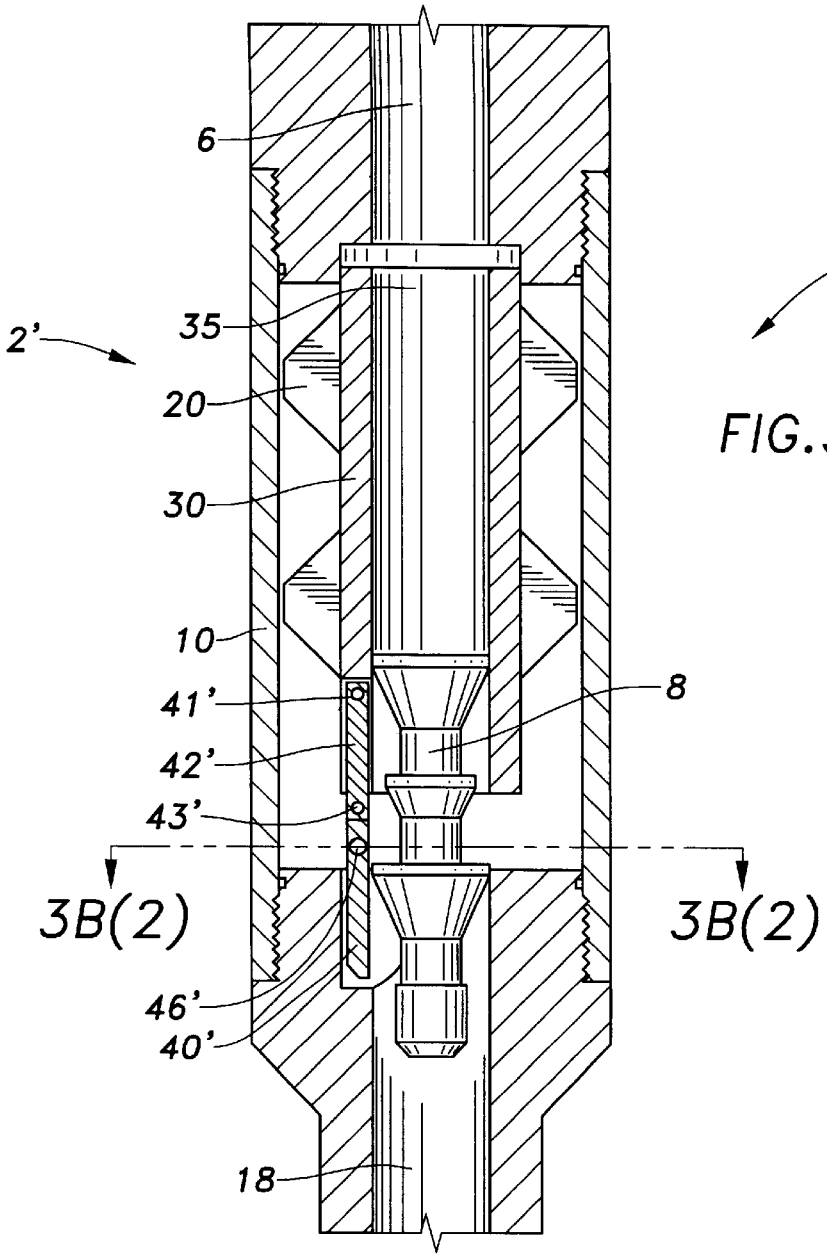
FIG.3B(1)
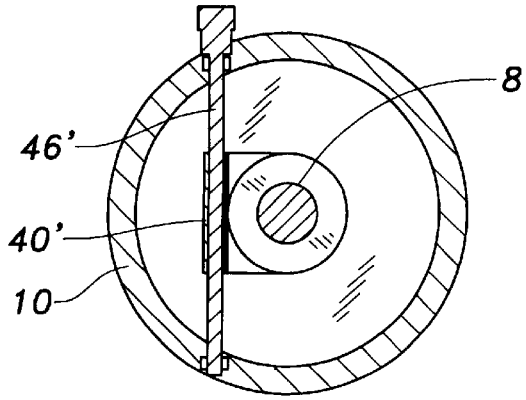
FIG.3B(2)

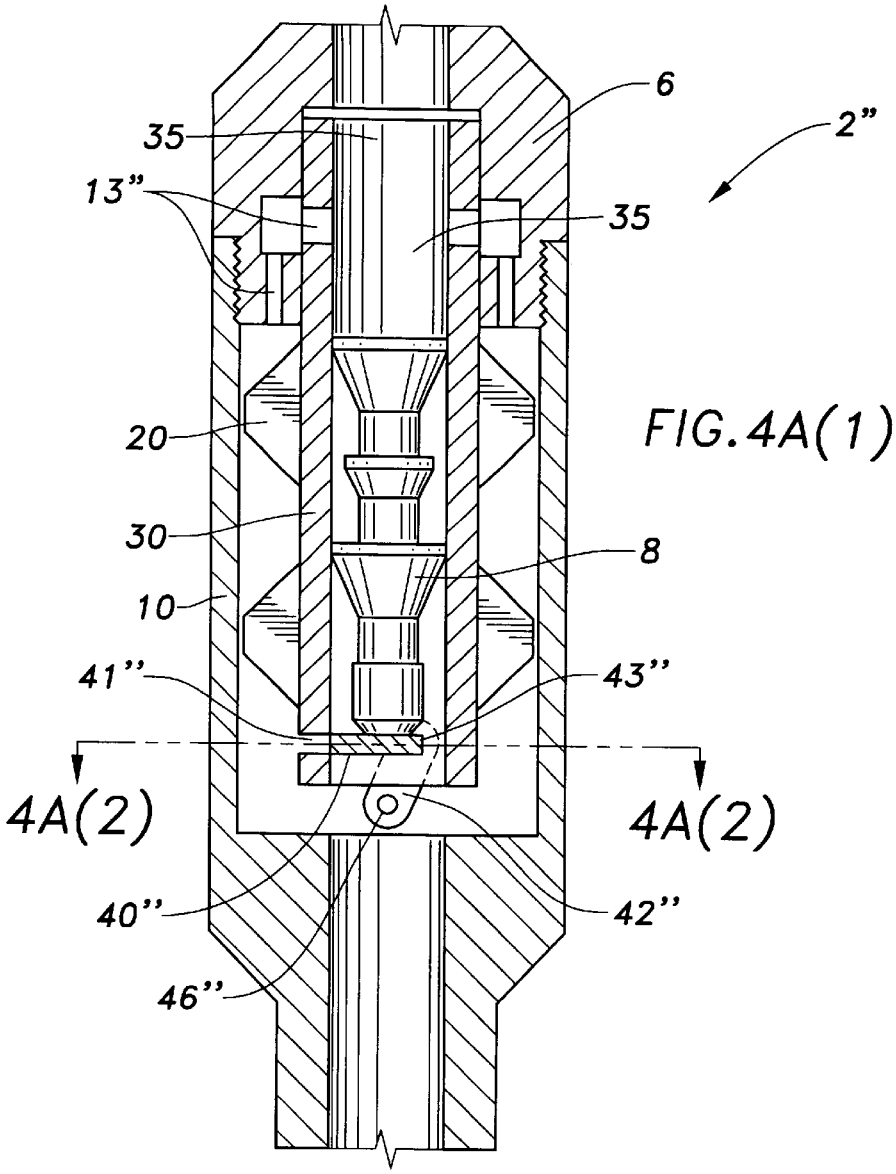
FIG. 4A(1)
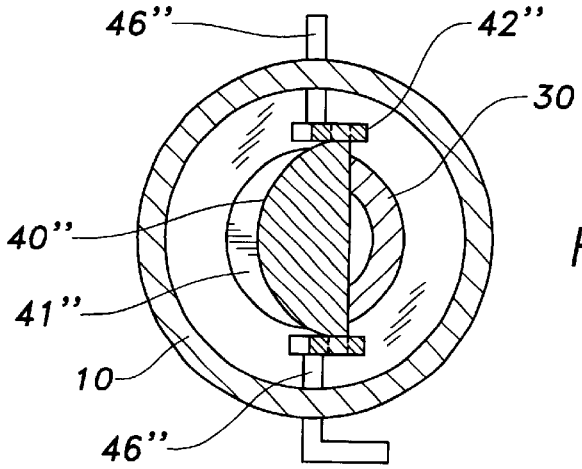
Fig. 4A(2)

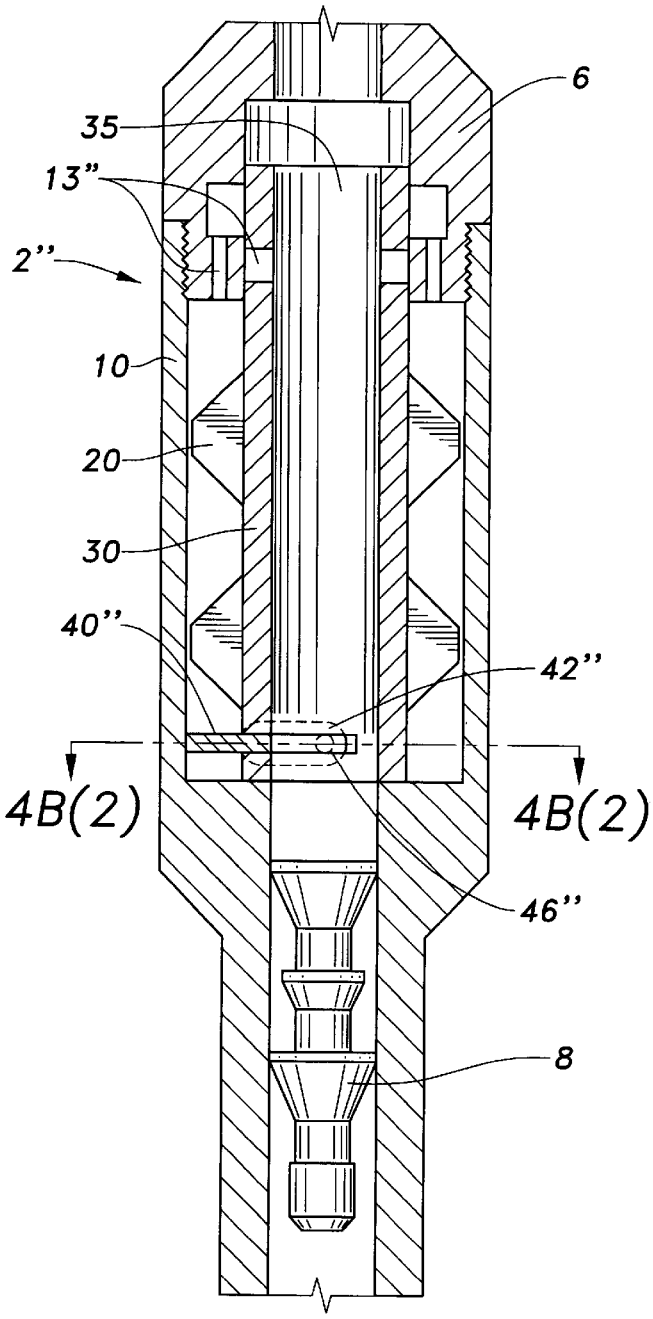
FIG.4B(1)
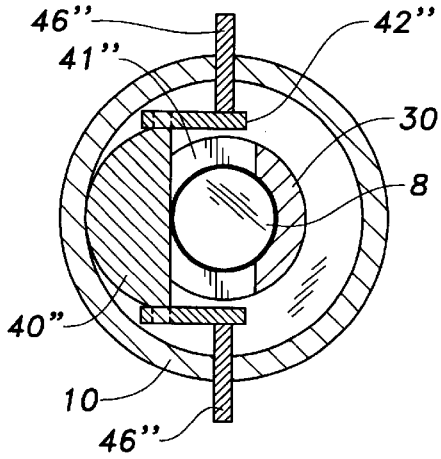
FIG.4B(2)

PLUG-DROPPING CONTAINER FOR RELEASING A PLUG INTO A WELLBORE

BACKGROUND OF THE INVENTION

1. Field of the Invention

The present invention generally relates to an apparatus for dropping plugs into a wellbore. More particularly, the invention relates to a plug-dropping container for releasing plugs and other objects into a wellbore, such as during cementing operations.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing. Afterwards, the second casing string is also cemented. This process is typically repeated with additional liner strings until the well has been drilled to total depth. In this manner, wells are typically formed with two or more strings of casing of an ever-decreasing diameter.

In the process of forming a wellbore, it is sometimes desirable to utilize various plugs. Plugs typically define an elongated elastomeric body used to separate fluids pumped into a wellbore. Plugs are commonly used, for example, during the cementing operations for a liner.

The process of cementing a liner into a wellbore typically involves the use of liner wiper plugs and drill-pipe darts. A liner wiper plug is typically located inside the top of a liner, and is lowered into the wellbore with the liner at the bottom of a working string. The liner wiper plug has radial wipers to contact and wipe the inside of the liner as the plug travels down the liner. The liner wiper plug has a cylindrical bore through it to allow passage of fluids.

After a sufficient volume of circulating fluid or cement has been placed into the wellbore, a drill pipe dart or pump-down plug, is deployed. Using drilling mud, cement, or other displacement fluid, the dart is pumped into the working string. As the dart travels downhole, it seats against the liner wiper plug, closing off the internal bore through the liner wiper plug. Hydraulic pressure above the dart forces the dart and the wiper plug to dislodge from the bottom of the working string and to be pumped down the liner together. This forces the circulating fluid or cement that is ahead of the wiper plug and dart to travel down the liner and out into the liner annulus.

Typically, darts used during a cementing operation are held at the surface by plug-dropping containers. The plug-dropping container is incorporated into the cementing head above the wellbore. Fluid is directed to bypass the plug within the container until it is ready for release, at which time the fluid is directed to flow behind the plug and force it downhole. Existing plug-dropping containers, such as cementing heads, utilize a variety of designs for allowing fluid to bypass the plug before it is released. One design used is an externally plumbed bypass connected to the bore body of the container. The external bypass directs the fluid to enter the bore at a point below the plug position. When the plug is ready for release, an external valve is actuated to direct the fluid to enter the bore at a point above the plug, thereby releasing the plug into the wellbore.

Another commonly used design is an internal bypass system having a second bore in the main body of the cementing head. In this design, fluid is directed to flow into the bypass until a plug is ready for release. Thereafter, an internal valve is actuated and the flow is directed on to the plug.

There are disadvantages to both the external and internal bypass plug container systems. Externally plumbed bypasses are bulky because of the external manifold used for directing fluid. Because it is often necessary to rotate or reciprocate the plug container, or cementing head, during operation, it is desirable to maintain a compact plug container without unnecessary projections extending from the bore body. As for the internal bypass, an internal bypass requires costly machining and an internal valve to direct fluid flow. Additionally, the internal valve is subject to erosion by cement and drilling fluid.

In another prior art arrangement, a canister containing a plug is placed inside the bore of the plug container. The canister initially sits on a plunger. Fluid is allowed to bypass the canister and plunger until the plug is ready for release. Upon release from the plunger, the canister is forced downward by gravity and/or fluid flow and lands on a seat. The seat is designed to stop the fluid from flowing around the canister and to redirect the flow in to the canister in order to release the plug. However, this design does not utilize a positive release mechanism wherein the plug is released directly. If the cement and debris is not cleaned out of the bore, downward movement of the canister is impeded. This, in turn, will prevent the canister from landing on the seat so as to close off the bypass. If the bypass is not closed off, the fluid is not redirected through the canister to force the plug into the wellbore. As a result, the plug is retained in the canister even though the canister is "released."

The release mechanism in some of the container designs described above involves a threaded plunger that extends out from the bore body of the container, and requires many turns to release the plug. The plunger adds to the bulkiness of the container and increases the possibility of damage to the head member of the plug container. Furthermore, cross-holes are machined in the main body for plunger attachment. Because a plug container typically carries a heavy load due to the large amount of tubular joints hanging below it, it is desirable to minimize the size of the cross-holes because of their adverse effect on the tensile strength of the container.

Therefore, there is a need for a more effective plug-dropping apparatus for a cementing head. There is a further need for a cementing head that can efficiently release a plug into a wellbore. There is still a further need for a plug releasing apparatus that is more compact, easier to handle, and less expensive to manufacture.

SUMMARY OF THE INVENTION

The present invention generally relates to a plug-dropping container for use in a wellbore circulating system. An example of such a system is a cementing operation for a liner string. The plug-dropping container first comprises a tubular housing having a top end and a bottom end. The top end is in sealed fluid communication with a wellbore fluid circulation device. Thus, fluid injected into the cementing head will travel through the housing before being injected into the wellbore.

The plug-dropping container also comprises a canister disposed co-axially within the housing. An annulus is thus defined between the canister and the surrounding housing. The canister is likewise tubular in shape so as to provide a fluid channel therein. The canister also has a top opening and a bottom opening. However, the canister is configured so that it is movable axially within the housing. A bypass gap is left between the top opening of the canister and the bore of the head member. In one aspect of the invention, the bypass gap is created by configuring the length of the canister to be less than the length of the surrounding housing.

The canister is axially movable within the housing. In this respect, the canister can be moved axially within the housing from a lower position to an upper position. In its lower position, fluid is permitted to flow from the bore of the head member, through the bypass gap, and into the annular area around the canister. Fluid may thus bypass the channel within the canister. However, raising the canister to its upper position within the housing causes the top opening to approach the bore of the cementing head. This effectively shuts off the bypass gap, thereby forcing fluid to be injected into the wellbore through the canister channel.

The plug-dropping container is used to retain one or more plugs such as a drill pipe dart for a cementing operation. In this respect, the channel of the canister is configured to closely receive the dart. While the dart is retained within the canister, the canister is in its lower position. This permits fluid to travel around the canister and the dart therein. When the dart is to be dropped into the wellbore, the canister is raised so as to substantially shut off fluid flow through the bypass gap. This forces fluid to flow into the channel of the canister. Fluid pressure builds behind the dart, forcing it out of the canister.

The plug-dropping container finally comprises a plug-retaining device. In one aspect, the plug-retaining device is a tubular member having a fluid channel therein. The plug-retaining device also has a first end, a second end, and a wall therebetween. When the plug-dropping container is in its plug-retained position, the plug-retaining device is oriented such that the wall of the plug-retaining device blocks the downward flow of the dart. In this position, the dart prohibits the flow of fluid through the canister; instead, fluid travels around the canister and through the canister annulus.

At the point at which plug-release is desired, the canister is raised within the housing. In one aspect of the assembly of the present invention, this is accomplished by rotating the plug-retaining device. The plug-retaining device is rotatable between a plug-retained position and a plug-released position. In the plug-retained position, the plug-retaining device is turned such that it blocks the canister channel and prevents dropping of the plug. Blocking the canister channel causes fluid entering the housing to flow around the canister via the bypass gap. To release the plug, the plug-retaining device is rotated by turning one or more shafts connected thereto. Rotation of the shaft causes the canister to move up axially and to approach the bore of the head member, thereby closing off the bypass gap and directing fluid to flow directly into the channel of the canister. Turning the plug-retaining device to the plug-released position also causes the plug-retaining device channel to be in fluid communication with the canister channel. The plug-retaining device channel can then receive the plug, whereupon the plug is released into the wellbore. The plug-retaining device is then in position to receive both the dart and fluid flowing through the cementing head.

In another embodiment, one or more plug-dropping containers of the present invention may be stacked for sequential release of more than one plug in a cementing operation.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG 3A(1) is a cross-sectional view of a plug-dropping container in an alternate embodiment. In this arrangement, the plug-retaining device defines a flapper valve. The valve is in its plug-retained position, blocking release of the plug.

FIG. 3A(2) is a transverse cross-sectional view of the plug-dropping container of FIG. 3A(1). The cut is taken through line (2)—(2) of FIG. 3A(1).

FIG. 3B(1) presents a cross-sectional side view of the plug-dropping container of FIG. 3A(1), but with the valve in its opened position, permitting release of the plug.

FIG. 3B(2) is a transverse cross-sectional view of the plug-dropping container of FIG. 3B(1). The cut is taken through line (2)—(2) of FIG. 3B(1).

FIG. 4A(1) is a cross-sectional view of a plug-dropping container in an alternate embodiment. In this arrangement, the plug-retaining device defines a horizontal plate. The plate is in its plug-retained position, blocking release of the plug.

FIG. 4A(2) is a transverse cross-sectional view of the plug-dropping container of FIG. 4A(1). The cut is taken through line (2)—(2) of FIG. 4A(1).

FIG. 4B(1) presents a cross-sectional side view of the plug-dropping container of FIG. 4A(1), but with the plate in its opened position, permitting release of the plug.

FIG. 4B(2) is a transverse cross-sectional view of the plug-dropping container of FIG. 4B(1). The cut is taken through line (2)—(2) of FIG. 4B(1).

DETAILED DESCRIPTION OF THE PREFERRED EMBODIMENT

Figure 1A:
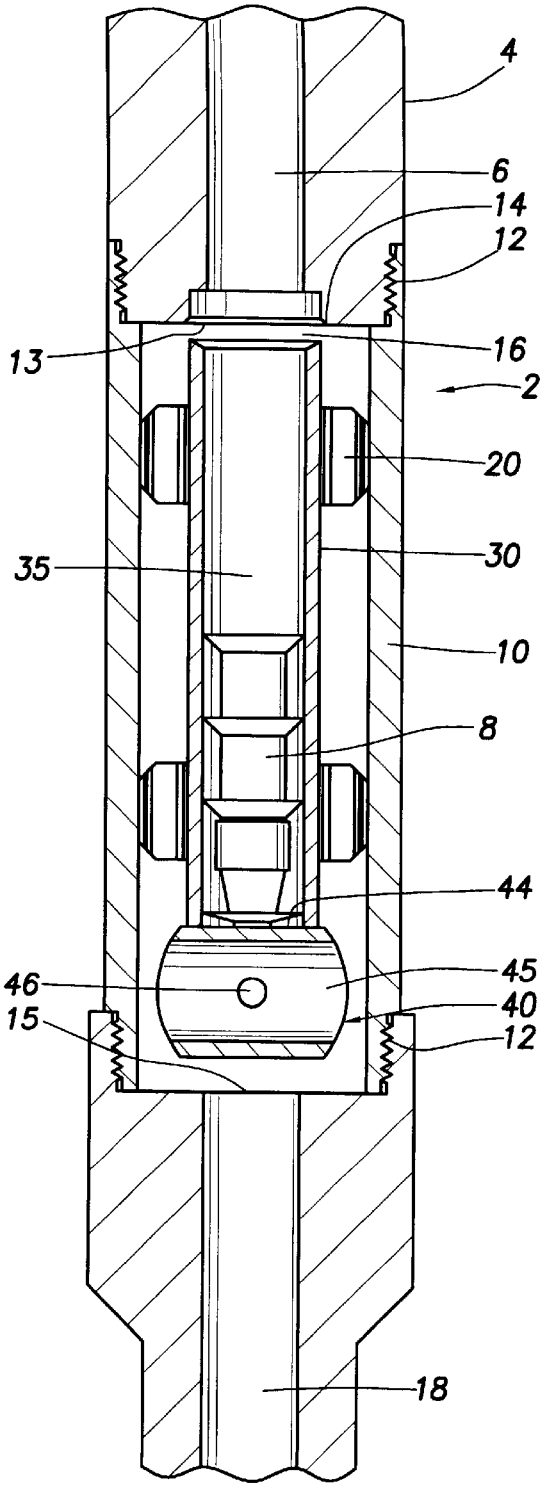
FIG. 1A is a partial schematic view of a plug-dropping container of the present invention, in its plug-retained position. In this view, the plug-retaining device is in its closed position, blocking release of the plug.

FIG. 1A is a partial schematic view showing one aspect of the plug-dropping container 2 of the present invention. The plug-dropping container 2 is shown with a dart 8 disposed therein. The plug-dropping container 2 includes a tubular housing 10 connected at its upper and lower ends to a head member 4 by threads 12. The head member 4 is part of a fluid circulation system such as a conventional cementing head. The upper and lower ends of the tubular housing 10 have openings 13 and 15 for fluid communication with the upper bore 6 in the head member 4.

Disposed generally co-axially within the housing 10 is a canister 30. The canister 30 is a tubular shaped member which resides within the tubular housing 10 of the plug-dropping container 2. This means that the outer diameter of the canister 30 is less than the inner diameter of the housing 10. At the same time, the inner diameter of the canister 30 is configured to generally match the inner diameter of the bore 6. As with the housing 10, the canister 30 has a top opening and a bottom opening. A channel 35 is formed axially in the canister 30. The channel is configured to closely receive and retain the dart 8 when the plug-dropping container 2 is in its plug-retained position.

The canister 30 is movable axially within the housing 10. In order to accommodate this movement, the length of the canister 30 is less than the length of the surrounding housing 10. The canister 30 is lowered and raised in order to move the canister 30 between a bypass open position and a bypass closed position.

FIG. 1A presents the canister 30 in its bypass open position. In the bypass open position, the top opening of the canister 30 is below the bore 6 of the head member 4, leaving a bypass gap 16 above the canister 30. The bypass gap 16 creates a bypass area for fluid being injected from the head member 4 into the lower bore 18. While FIG. 1A presents a bypass area formed by a shortened canister 30, it is understood that other arrangements for a bypass area may be employed, such as the use of ports which are selectively exposed when the canister 30 is in its lowered position within the surrounding housing 10. The use of ports for a bypass area is shown in the alternate embodiment of FIGS. 4A(1) and 4B(1), discussed below.

The canister 30 may be raised in order to close the bypass gap 16, thereby closing off the bypass flow of fluid. In this bypass-closed position, the top opening of the canister 30 approaches the bore 6 of the head member 4. This effectively shuts off the bypass area 16 above the canister 30. In the arrangement shown in FIG. 1A, the top opening of the canister 30 is designed to approach a seat 14 when the canister 30 is raised. The seat 14 is disposed proximal to the lower portion of the bore 6 for approximately contacting the canister 30. The seat 14 can be disposed either at the bottom of the bore 6, or at the upper end of the tubular housing 10.

The canister 30 is generally aligned within the tubular housing 10. Preferably, the canister 30 is centralized within the tubular housing 10 by spacers 20 positioned between the outer wall of the canister 30 and the inner wall of the housing 10. The spacers 20 are preferably attached to the outer wall of the canister 30 and travel with the canister 30 as the canister 30 is raised or lowered. Alternatively, the spacers 20 may be attached to the inside of the tubular housing 10 so that the canister 30 moves axially relative to the spacers 20.

In order to move the canister 30 between its bypass-flow state (the bypass-open position) to its open-flow state (the bypass-closed position), a diverting mechanism 40 is provided. In the arrangement shown in FIGS. 1A and 1B, the diverting mechanism 40 is a tubular body disposed below the canister 30. As will be discussed below, rotation of the diverting mechanism 40 serves to selectively raise and lower the canister 30 within the surrounding housing 10.

Figure 1B:
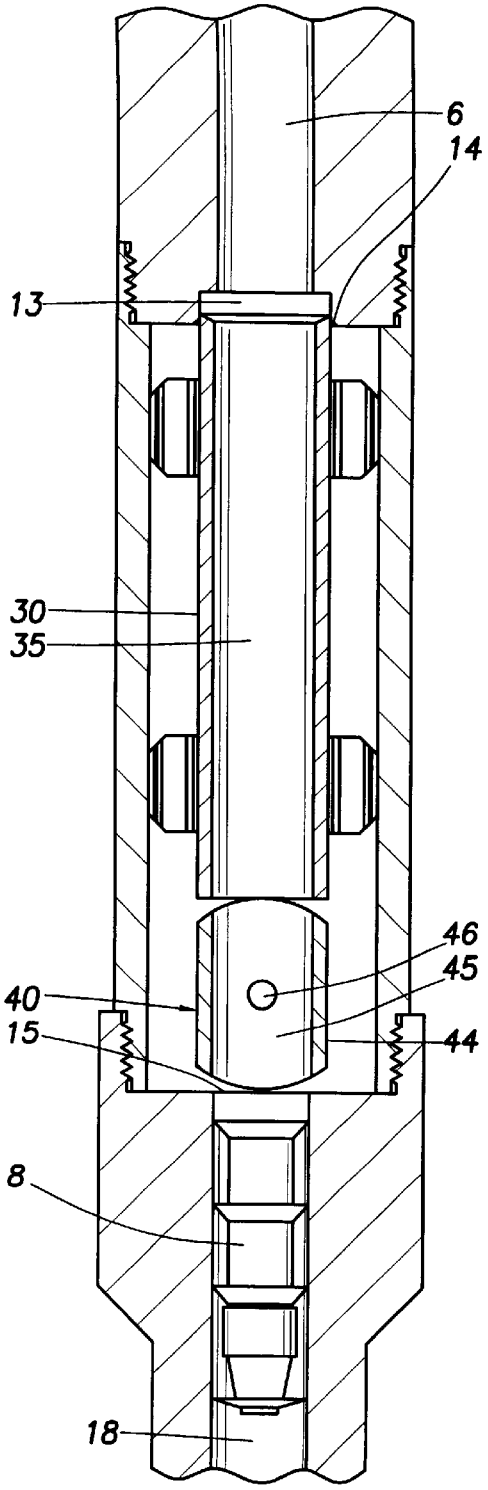
FIG. 1B is a partial schematic view of a plug-dropping container of the present invention, in its plug-released position. In this view, the plug-retaining device is in its open position, allowing the plug to be released down into the wellbore.

The plug-dropping container 2 of the present invention further comprises a plug-retaining device 40. In the arrangement of FIGS. 1A and 1B, the diverting mechanism 40, also serves as the plug-retaining device 40. The plug-retaining device 40 has a first end, a second end, and a wall 44 therebetween. The plug-retaining device 40 also has a bore therein which serves as a fluid channel 45. When the plug-dropping container 2 is in its plug-retained position, the plug-retaining device 40 is oriented such that the wall 44 of the plug-retaining device 40 blocks the downward flow of the dart 8. In this position, the dart 8, in turn, prohibits the flow of fluid from the bore 6 of the head member 4 and through the canister 30. Instead, fluid travels around the canister 30, via the bypass area 16 and through the canister annulus.

The plug-retaining device 40 is rotatable within the tubular housing 10 by a pivoting connection 46. In FIG. 1A, the pivoting connection 46 defines a shaft 46 that extends through the tubular housing 10 perpendicular to the channel 35. The shaft 46 is rotated to move the plug-retaining device 40 from the plug-retained position to the plug-released position.

In the embodiment of FIG. 1A, rotation of the plug-retaining device 40 also serves to raise or lower the canister 30. To effectively move the canister 30 axially, the distance from one end of the plug-retaining device 40 to the shaft 46 is greater than the distance from the wall 44 of the plug-retaining device 40 to the shaft 46. Having one end of the plug-retaining device 40 longer than the distance to the wall 44 of the plug-retaining device 40 allows the plug-retaining device 40 to selectively raise or lower the canister 30 when the plug-retaining device 40 is rotated approximately 90 degrees. Preferably, the plug-retaining device 40 has rounded corners to facilitate rotation and respective axial movement of the canister 30. Thus, movement of the plug-retaining device 40 from the plug-retained position to the plug-released position also moves the canister 30 from its bypass-flow state to its open-flow state.

It is to be understood that any means for moving the canister 30 from its lower position to its upper position is within the spirit and scope of the present invention. Other diverting mechanisms may be used for manipulating the canister 30, such as a cam, a gear driver, a flapper valve and a plate. The novel employment of a tubular plug-retaining device 40 as shown in FIGS. 1A and 1B avoids the use of a separate actuating mechanism. The use of a flapper valve as the plug-retaining device is shown in FIGS. 3A(1), 3A(2), 3B(1) and 3B(2). The use of a plate as the plug-retaining device is shown in FIGS. 4A(1), 4A(2), 4B(1) and 4B(2).

In FIG. 1A, the plug-dropping container 2 is in the plug-retained position. In this position, the plug-retaining device/diverting mechanism 40 is oriented so that the wall 44 is in contact with the canister 30. This serves to effectively retain the plug 8 within the canister 30. In FIG. 1B, the plug-dropping container 2 is in the plug-released position. In this position, the plug-retaining device/diverting mechanism 40 is rotated so that the channel 45 may receive both the dart 8 and fluid from the canister 30. In the plug-released position, the channel 35 of the canister 30 is in general alignment with the channel 45 of the plug-retaining device/diverting mechanism 40. This allows the plug 8 to be easily released. As shown in FIG. 1B, the plug-retaining device channel 45 has approximately the same diameter as the canister channel 35.

It is preferred that a shaft 46 extending on opposite sides of the plug-retaining device 40 be used to connect the plug-retaining device 40 to the tubular housing 10. The shaft 46 may be rotated manually or be power-driven. It is understood, however, that any connection between the housing 10 and the plug-retaining device 40 is within the scope of the present invention.

In the plug-retained position, shown in FIG. 1A, the plug-retaining device 40 is positioned so that the canister 30 rests on a wall 44 of the plug-retaining device 40. In this position, the plug-retaining device channel 45 is perpendicular to, and not in fluid communication, with the canister channel 35. The path of the plug 45 is blocked so that it cannot exit the canister 30. In the preferred embodiment, the wall 44 of the plug-retaining device 40 is flat in configuration. This aids in obtaining a fluid seal when the plug-retaining device 40 is in its closed position, shown in FIG. 1A.

The canister 30 is in a lowered position when it rests on the wall 44 of the plug-retaining device 40. Because the lower opening of the canister channel 35 is blocked off, fluid entering the tubular housing 10 from the upper opening 13 must generally flow around the canister 30 to exit at the lower opening 15 at the bottom of the tubular housing 10. Visible in FIG. 1A is the bypass gap 16 between the canister 30 and the seat 14 enabling fluid to flow around the canister 30. In this position, plug 8 retention is achieved.

When the plug 8 is ready for release, the plug-retaining device 40 is rotated to the second, or open, position, illustrated in FIG. 1B. The rotation axially aligns the plug-retaining device channel 45 with the canister channel 35 for fluid communication. The rotation also causes the canister 30 to move up axially and approach the bore 6 of the head member 4. The canister 30 moves up because the distance from one end of the plug-retaining device 40 to the shaft 46 is greater than the distance from the wall 44 of the plug-retaining device 40 to the shaft 46. As the top opening of the canister 30 approaches the seat 14, the bypass gap 16 is substantially shut off. Fluid is thereby redirected to flow directly through the canister channel 35 and the plug-retaining device channel 45. A combination of fluid flow and gravity releases the plug 8 into the lower bore 18. However, it is within the scope of this invention to release the plug directly into the wellbore (not shown).

Figure 2A:
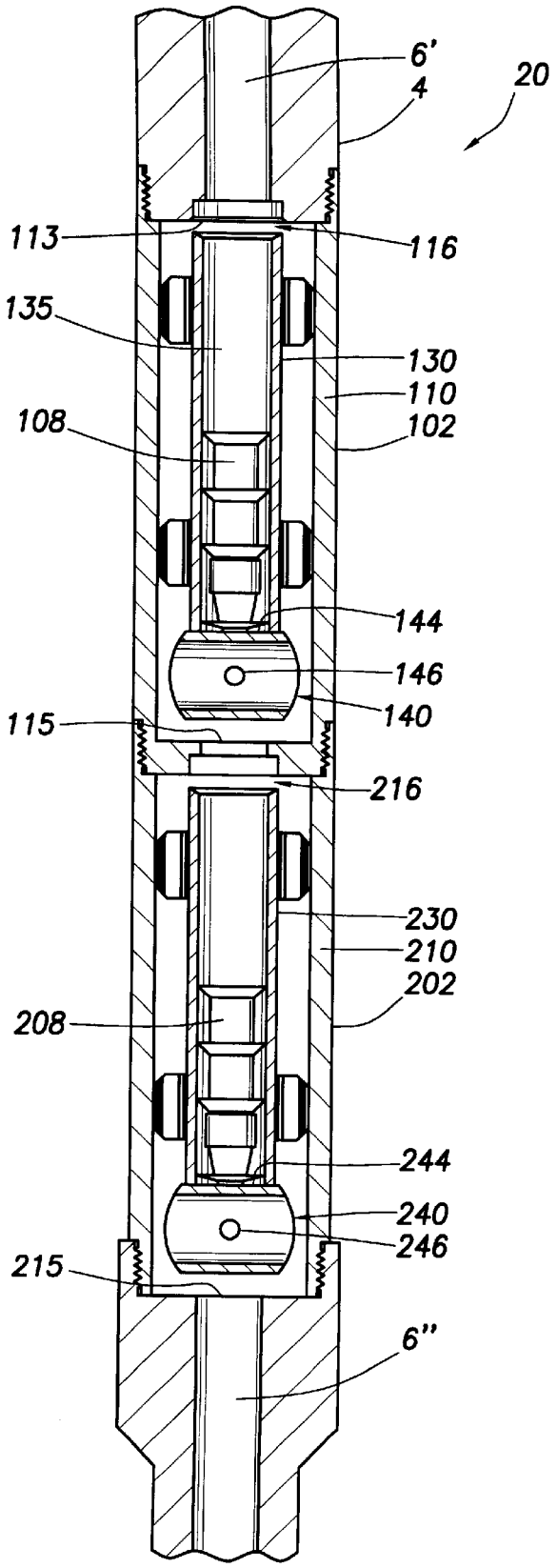
FIG. 2A is a partial schematic view of an alternative embodiment of a plug-dropping container of the present invention. In this view, two plug-dropping containers are stacked one on top of another. Both plug-dropping containers are in the plug-retained position, thereby blocking the release of the plugs.

In many cementing operations, two plugs are released. In order to accommodate the release of two plugs, an alternate embodiment of the plug container is provided. An alternate embodiment is shown in FIG. 2A.

In operation, two tools 102, 202 according to the present invention are disposed below the head member 4, and stacked on top of one another. As illustrated in FIG. 2A, the tools 102, 202 are initially in the plug-retained position. Drilling fluid, or other circulating fluid, is introduced into the upper portion of a tubular housing 110 through a bore 6' and an upper opening 113 of the tubular housing 110. The fluid generally flows around an upper canister 130 through an upper bypass 116, and exits a lower opening 115 of the lower portion of the tubular housing 110. The fluid then flows through a lower bypass 216, and a lower opening 215 of the lower portion of the tubular housing 210. From there, the fluid exits into a lower bore 6", which may be a bore in the cementing head or may be the wellbore itself. In one aspect of the present invention, the lower bore 6" defines the upper portion of the wellbore.

Figure 2B:
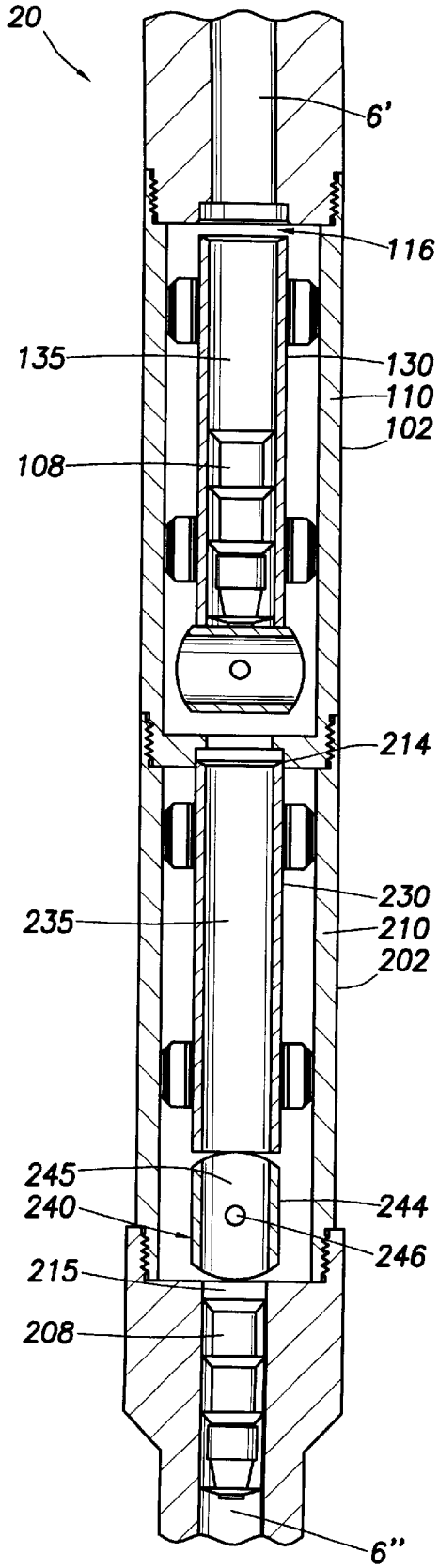
FIG. 2B is a partial schematic view of an alternative embodiment of a plug-dropping container of the present invention. Here, two plug-dropping containers are stacked on top of one another. The lower plug-dropping container has released its plug.

A bottom plug 208 is disposed in the lower canister 230 to be released into the wellbore. The bottom plug 208 may be used to clean the drill string or other piping of drilling fluid and to separate the cement from the drilling fluid. Release of the bottom plug 208 is illustrated in FIG. 2B. To release the bottom plug 208, the plug-retaining device 240 of the lower portion of the tubular housing 210 is rotated by turning a shaft 246 connected to the plug-retaining device 240. The plug-retaining device 240 is rotated to align a plug-retaining device channel 245 with the canister channel 235 for fluid communication. In this manner, the plug-retaining device 240 is moved from a plug-retained position to a plug-released position such that the wall 244 of the bottom plug-retaining device 240 no longer blocks downward travel of the bottom plug 208. Rotation of shaft 246 also raises the lower canister 230 axially and moves the upper end of the lower canister 230 proximate to a seat 214 disposed above the lower canister 230

Seating the lower canister 230 essentially seals off the lower bypass 216 and substantially redirects the fluid into the canister channel 235. Cement flow and gravity release the bottom plug 208 into the wellbore.

The present invention relates to a plug-dropping container for releasing plugs or other objects into a wellbore during fluid circulation procedures. The plug-dropping container comprises an elongated housing, and a canister disposed co-axially within the housing. The canister is movable from a lower position to an upper position. In its lower position, a fluid bypass area is defined above the canister. When a dart is retained within the canister, fluid is diverted through the bypass and around the canister within an annular area defined between the canister and the housing. In one aspect, the canister is moved by rotation of a plug-retaining device below the canister.

Figure 2C:
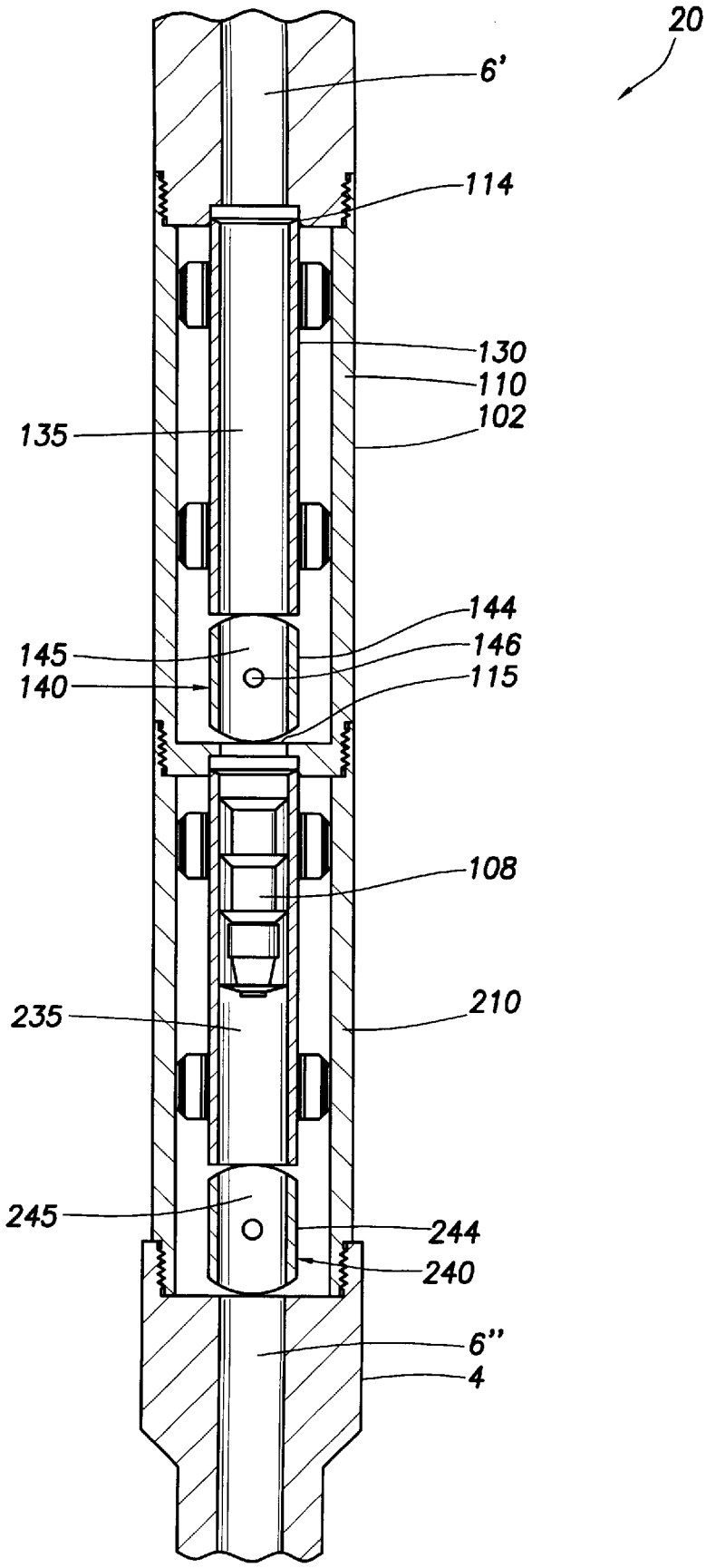
FIG. 2C is a partial schematic view of an alternative embodiment of a plug-dropping container of the present invention. Again, two plug-dropping containers are stacked on top of one another. In this view, both plug-dropping containers have released their plugs into the wellbore.

After a sufficient amount of cement is supplied to fill the annular space, the top plug 108 is released behind the cement. In this instance, drilling fluid is pumped in behind the top plug 108. The top plug 108 separates the two fluids and cleans the drill string or other piping of cement. To release the top plug 108, the plug-retaining device 140 of the upper portion of the tubular housing 110 is rotated to align the plug-retaining device channel 145 with the canister channel 135, as illustrated in FIG. 2C. In this manner, the plug-retaining device 140 is moved from a plug-retained position to a plug-released position such that the wall 144 of the top plug-retaining device 140 no longer blocks downward travel of the top plug 108. The rotation raises the upper canister 130 into proximity with the lower end of the bore 6' thereby substantially shutting off the upper bypass gap 116. Drilling mud or other fluid is substantially directed into the canister channel 135 and forces the top plug 108 downward. The top plug 108 travels through the plug-retaining device channel 145 and the lower opening 115 of the upper tubular housing 110 and continues down through the canister channel 235, and the plug-retaining device channel 245 of the lower portion of the tubular housing 210. The top plug 108 exits into the lower bore 6" and continues into the wellbore with the drilling mud immediately behind it.

FIG. 3A(1) is a cross-sectional view of a plug-dropping container 2' in an alternate embodiment. In this arrangement, the plug-retaining device 40' defines a flapper valve. The valve 40' is in its plug-retained position, blocking release of the plug 8. The valve 40' is pivotally movable about a shaft 46'.

FIG. 3A(2) is a transverse cross-sectional view of the plug-dropping container 2' of FIG. 3A(1). The cut is taken through line (2)—(2) of FIG. 3A(1). In this view, the shaft 46' is more clearly seen extending through the housing 10.

A proximate end of the flapper valve 40' is connected to a pivot bar 42'. More specifically, the flapper valve 40' and the pivot bar 42' are each connected at an end to a pin 43'. At an opposite end, the pivot bar 42' is connected to the canister 30 by means of a second pin 41'. Thus, when the flapper valve 40' is rotated from its closed position to an open position, the pivot bar 42' acts upwardly against the canister 30, causing it to raise.

FIG. 3B(1) presents a cross-sectional side view of the plug-dropping container 2' of FIG. 3A(1), but with the valve 40' in its opened position. To reach the open position, the shaft 46' has been rotated 90 degrees. Rotation of the shaft 46' also serves to move the pivot bar 42' upward within the housing 10. This, in turn, causes the canister 30 to also move upward, substantially closing off the bypass area 13. After the shaft 46' is rotated, the flapper valve 40' is in its open position, permitting release of the plug 8.

FIG. 3B(2) is a transverse cross-sectional view of the plug-dropping container 2' of FIG. 3B(1). The cut is taken through line (2)—(2) of FIG. 3B(1). It can be seen that the shaft 46' has been turned to open the flapper valve 40'.

FIG. 4A(1) is a cross-sectional view of a plug-dropping container 2" in an alternate embodiment. In this arrangement, the plug-retaining device 40" defines a horizontal plate. The plate 40" is in its plug-retained position, blocking release of the dart 8. In addition, FIG. 4A(1) presents the use of one or more ports 13" to form the bypass area.

FIG. 4A(2) is a transverse cross-sectional view of the plug-dropping container 2" of FIG. 4A(1). The cut is taken through line (2)—(2) of FIG. 4A(1). In this view, the shaft 46" is more clearly seen extending through the housing 10.

One end of the horizontal plate 40" is proximate to a slot 41" in the canister 30. The thickness of the plate 40" is dimensioned to slide through the slot 41" when the plate 40" is moved from its closed position to an open position. At an opposite end, the plate 40" is connected to a pivot bar 42". Connection is by means of a second pin 43'.

Movement of the plate 40" from its closed position to an open position is again accomplished by rotating the shaft 46". The pivot bar 42' is connected to the shaft 46" at an end opposite to pin 43'. Thus, when the shaft 46" is rotated 90 degrees, the pivot bar 42' moves the plate 40" through the slot 41", opening the canister 30 and its channel 35 to release the dart 8.

FIG. 4B(1) presents a cross-sectional side view of the plug-dropping container 2" of FIG. 4A(1), but with the plate 40" in its opened position, permitting release of the plug 8. Consistent with the present invention, actuation of the plug-retaining device, e.g., plate 40", serves to also move the canister 30. In the arrangement of FIGS. 4A(1) and 4B(1), actuation of the plate 40" moves the canister 30 down rather than up within the housing 10. However, the linkage may also be configured to move the canister 30 up rather than down. Ports 13" are provided as the bypass area. The ports 13" in one embodiment define separate ports through the head 6, and through the canister 30 above the head ports. When the canister 30 is lowered, the ports 13" are covered by the head 6.

FIG. 4B(2) is a transverse cross-sectional view of the plug-dropping container 2" of FIG. 4B(1). The cut is taken through line (2)—(2) of FIG. 4B(1). It can be seen that the shaft 46" has been turned to open the plate 40".

While the foregoing is directed to embodiments of the present invention, other and further embodiments of the invention may be devised without departing from the basic scope thereof, and the scope thereof is determined by the claims that follow. In this respect, it is within the scope of the present invention to use the plug containers disclosed herein to place plugs for various cleaning and fluid circulation procedures in addition to cementing operations for liners. In addition, the plug-dropping container of the present invention has utility in the context of deploying darts or plugs for the purpose of initiating subsea release of wiper plugs. It is further within the spirit and scope of the present invention to utilize the plug-dropping container disclosed herein for dropping items in addition to drill pipe darts and other plugs. Examples include, but are not limited to, balls and downhole bombs.

What is claimed is:

1. A plug-dropping container within a head member for releasing an object into a wellbore, the plug-dropping container comprising:

a tubular housing;

a canister disposed within and generally aligned with said tubular housing so as to define an annulus between said tubular housing and said canister, said canister being movable axially within said housing from a lower position to an upper position;

a channel within said canister, said canister channel being configured to receive the object therein;

a bypass proximate to the top end of said canister for permitting fluid to flow into said annulus when said canister is in its lower position, said bypass being substantially shut off when said canister is raised to its upper position within said housing;

a plug-retaining device disposed within said tubular housing below said canister, said plug-retaining device having a first end, a second end, and a wall therebetween;

a channel within said plug-retaining device for placing said first and second ends of said plug-retaining device in fluid communication;

and wherein said plug-retaining device is movable from an object-retained position to an object-released position, such that said wall of said plug-retaining device substantially blocks the object from exiting said canister when said plug-retaining device is in its object-retained position, and said channel of said plug-retaining device is in substantial alignment with said channel of said canister when said plug-retaining device is in its object-released position, thereby permitting the object to exit said canister and to travel downward through said channel of said plug-retaining device.

2. The plug-dropping container of claim 1, wherein said object is a plug.

3. The plug-dropping container of claim 2, wherein said plug is a dart.

4. The plug-dropping container of claim 2, wherein said tubular housing comprises a top opening and a bottom opening, and wherein said housing is in fluid communication with a bore in the head member.

5. The plug-dropping container of claim 4, wherein said canister further comprises a top opening and a bottom opening.

6. The plug-dropping container of claim 4, wherein said bypass is between said top opening of said canister, and the bore of the head member.

7. The plug-dropping container of claim 4, wherein the head member is a cementing head.

8. The plug-dropping container of claim 1, wherein said object is a ball.

9. The plug-dropping container of claim 1, wherein said object is a bomb.

10. A plug-dropping container within a head member for releasing a plug into a wellbore, the plug-dropping container, comprising:

a tubular housing;

a canister disposed within and generally aligned with said tubular housing so as to define an annulus between said tubular housing and said canister, said canister having a top opening and a bottom opening, and said canister being movable axially within said housing between a lower position and an upper position;

a channel within said canister, said canister channel being configured to receive the plug therein;

a bypass proximate to the said top opening of said canister for permitting fluid to flow into said annulus when said canister is in its lower, bypass-open position, and said bypass being substantially shut off when said canister is raised to its upper, bypass-closed position within said housing;

a plug-retaining device disposed within said tubular housing below said canister, said plug-retaining device having a first end, a second end, and a wall therebetween;

a channel within said plug-retaining device for placing said first and second ends of said plug-retaining device in fluid communication;

and wherein said plug-retaining device is movable from a plug-retained position to a plug-released position, such that said wall of said plug-retaining device substantially blocks the plug from exiting said canister when said plug-retaining device is in its plug-retained position, and said channel of said plug-retaining device is in substantial alignment with said channel of said canister when said plug-retaining device is in its plug-released position, thereby permitting the plug to exit said canister and to travel downward through said channel of said plug-retaining device.

11. The plug-dropping container of claim 10, wherein said tubular housing comprises a top opening and a bottom opening, and wherein said housing is in fluid communication with a bore in the head member.

12. The plug-dropping container of claim 11, wherein said plug-retaining device is moved from its plug-retained position to its plug-released position by rotating said plug-retaining device approximately 90 degrees.

13. The plug-dropping container of claim 12, wherein rotation of said plug-retaining device from its plug-retained position to its plug-released position further serves to move said canister from its bypass-open position to its bypass-closed position.

14. The plug-dropping container of claim 13, wherein the head member is a cementing head.

15. The plug-dropping container of claim 14, wherein rotation of said plug-retaining device is via a pivoting connection; and wherein the distance from one end of the plug-retaining device to said pivoting connection is greater than the distance from said wall of said plug-retaining device to said pivoting connection.

16. The plug-dropping container of claim 15, wherein said pivoting connection comprises a shaft about which said plug-retaining device is rotated between its plug-retained position and its plug-released position.

17. The plug-dropping container of claim 15, wherein said channel of said plug-retaining device is in generally axial alignment with the wellbore when said channel of said plug-retaining device is in its open position, thereby providing a channel through which the plug can enter the wellbore.

18. The plug-dropping container of claim 17, wherein said bypass is between said top opening of said canister, and a bore in the head member.

19. The plug-dropping container of claim 18, further comprising at least one spacer disposed between said housing and said canister for essentially centralizing said canister within said housing.

20. The plug-dropping container of claim 19, further comprising a seat above said canister and in contact with the bore of the head member.

21. A cementing head having a plug-dropping container for releasing a plug into a wellbore during a cementing operation, the cementing head having a bore therein for receiving fluids, the plug-dropping container, comprising:

a tubular housing having a top opening and a bottom opening, said housing being in fluid communication with the bore in the head member;

a canister disposed within and generally aligned with said tubular housing so as to define an annulus between said tubular housing and said canister, said canister also having a top opening and a bottom opening, and said canister being movable axially within said housing from a lower position to an upper position;

a channel within said canister, said canister channel being configured to receive a plug therein;

a bypass proximate to the top end of said canister for permitting fluid to flow into said annulus when said canister is in its lower, bypass-open position, said bypass being substantially shut off when said canister is raised to its upper, bypass-closed position within said housing;

a plug-retaining device disposed within said tubular housing below said bottom opening of said canister, said plug-retaining device having a first end, a second end, and a wall therebetween;

a channel within said plug-retaining device for placing said first and second ends of said plug-retaining device in fluid communication; and at least one pivoting connection for rotating said plug-retaining device from a plug-retained position to a plug-released position, such that said wall of said plug-retaining device substantially blocks the plug from exiting said canister when said plug-retaining device is in its plug-retained position, and said channel of said plug-retaining device is in substantial alignment with said channel of said canister when said plug-retaining device is in its plug-released position, thereby permitting the plug to exit said canister and to travel downward through said channel of said plug-retaining device.

22. The plug-dropping container of claim 21, wherein the distance from one end of the plug-retaining device to said pivoting connection is greater than the distance from said wall of said plug-retaining device to said pivoting connection.

23. The plug-dropping container of claim 22, further comprising at least one spacer disposed between said housing and said canister for essentially centralizing said canister within said housing.

24. The plug-dropping container of claim 22, further comprising a seat above said canister and in contact with the bore of the head member.

25. The plug-dropping container of claim 24, wherein rotation of said plug-retaining device from its plug-retained position to its plug-released position causes said canister to move toward said seat, thereby moving said canister from its bypass-open position to its bypass-closed position.

26. A plug-dropping container for dispensing plugs into a wellbore during a cementing operation, the plug-dropping container being connected to a cementing head having a bore therein for receiving fluids, the plug-dropping container, comprising:

a tubular housing having a top opening and a bottom opening, said housing being in fluid communication with the bore in the cementing head;

an upper canister disposed within and generally aligned with said housing so as to define an annulus between said tubular housing and said upper canister, said upper canister also having a top opening and a bottom opening, and said upper canister being movable axially within said housing from a lower position to an upper position;

a channel within said upper canister, said channel of said upper canister being configured to receive a top plug therein;

an upper bypass between said top opening of said upper canister, and the bore for permitting fluid to flow into said annulus when said upper canister is in its lower position, said upper bypass being substantially shut off when said upper canister is raised to its upper position within said housing;

an upper plug-retaining device disposed within said housing below said bottom opening of said upper canister, said upper plug-retaining device having a first end, a second end, and a wall therebetween;

a channel within said upper plug-retaining device for placing said first and second ends of said first plug-retaining device in fluid communication;

a lower canister disposed within and generally aligned with said housing and below said upper plug-retaining device so as to define an annulus between said housing and said lower canister, said lower canister also having a top opening and a bottom opening, and said lower canister also being movable axially within said housing from a lower position to an upper position;

a channel within said lower canister, said channel of said lower canister being configured to receive a bottom plug therein;

a lower bypass between said top opening of said lower canister, and said upper plug-retaining device;

a lower plug-retaining device disposed within said housing below said bottom opening of said lower canister, said lower plug-retaining device having a first end, a second end, and a wall therebetween;

a channel within said lower plug-retaining device for placing said first and second ends of said lower plug-retaining device in fluid communication;

said lower plug-retaining device rotating between a plug-retained position and a plug-released position, such that said wall of said lower plug-retaining device substantially blocks the bottom plug from exiting said lower canister when said lower plug-retaining device is in its plug-retained position, and said channel of said lower plug-retaining device is in substantial alignment with said channel of said lower canister when said lower plug-retaining device is in its plug-released position, thereby permitting the bottom plug to exit said lower canister and to travel downward through said channel of said lower plug-retaining device; and said upper plug-retaining device rotating between a plug-retained position and a plug-released position, such that said wall of said upper plug-retaining device substantially blocks the top plug from exiting said upper canister when said upper plug-retaining device is in its plug-retained position, and said channel of said upper plug-retaining device is in substantial alignment with said channel of said upper canister when said upper plug-retaining device is in its plug-released position, thereby permitting the top plug to exit said upper canister and to travel downward through said channel of said upper plug-retaining device.

27. The plug-dropping container of claim 26, wherein said lower plug-retaining device and said upper plug-retaining device each rotate about a respective pivoting connection.

28. The plug-dropping container of claim 27, wherein the distance from one end of said upper plug-retaining device to said pivoting connection of said upper plug-retaining device is greater than the distance from said wall of said upper plug-retaining device to said shaft of said pivoting connection of said upper plug-retaining device; and the distance from one end of said lower plug-retaining device to said pivoting connection of said lower plug-retaining device is greater than the distance from said wall of said lower plug-retaining device to said shaft of said pivoting connection of said lower plug-retaining device.

29. The plug-dropping container of claim 28, wherein said pivoting connection comprises at least one shaft.

30. A plug-dropping container within a head member for releasing a plug into a wellbore, the plug-dropping container, comprising:

a tubular housing;

a canister disposed within and generally aligned with said tubular housing so as to define an annulus between said tubular housing and said canister, said canister having a top end and a bottom end, and said canister being movable axially within said housing from a lower position to an upper position in order to move said canister from its bypass-flow position to its open-flow position;

a channel within said canister, said canister channel being configured to receive the plug therein;

a bypass proximate to the top end of said canister for permitting fluid to flow into said annulus when said canister is in its lower position, said bypass being substantially shut off when said canister is raised to its upper position within said housing;

a diverting mechanism that forces said canister to move from its bypass-open position to its bypass-closed position; and a plug-retaining device disposed below said canister, said plug-retaining device selectively movable from a plug-retained position wherein the plug is restricted from exiting said tubular housing, to a plug-released position wherein the plug may exit said tubular housing.

31. The plug-dropping container of claim 30, wherein said plug-retaining device also functions as said diverting mechanism.

32. A plug-dropping container within a head member for releasing a plug into a wellbore, the plug-dropping container comprising:

a tubular housing;

a canister disposed within and generally aligned with said tubular housing so as to define an annulus between said tubular housing and said canister, said canister being movable axially within said housing in order to move said canister between a bypass-open position and a bypass-closed position;

a channel within said canister, said canister channel being configured to receive the plug therein;

a bypass at an end of said canister for permitting fluid to flow through said annulus when said canister is in its bypass-open position, said bypass being substantially shut off when said canister is moved to its bypass-closed position within said housing;

a plug-retaining device disposed below said canister, said plug-retaining device selectively movable from a plug-retained position wherein the plug is restricted from exiting said tubular housing, to a plug-released position wherein the plug may exit said tubular housing; and a diverting mechanism that forces said canister to move from its bypass-open position to its bypass-closed position.

33. The plug-dropping container of claim 32, wherein said plug-retaining device also functions as said diverting mechanism.

34. The plug-dropping container of claim 33, wherein said plug-retaining device comprises a flapper whose movement is mechanically linked to said canister.

35. The plug-dropping container of claim 33, wherein said plug-retaining device comprises a horizontal plate whose movement is mechanically linked to said canister.

36. The plug-dropping container of claim 33, wherein said plug-retaining device comprises an elongated body having a bore, the body being rotatable so as to selectively rotate said bore into and out of alignment with said canister, and whose rotation forces movement of said canister; and wherein rotation of said plug-retaining device serves to move said canister between its bypass-open position and its bypass-closed position.

37. The plug-dropping container of claim 32, wherein said diverting mechanism comprises at least one cam.

38. A plug-dropping container within a head member for releasing a plug into a wellbore, the plug-dropping container, comprising:

a tubular housing;

a canister disposed within and generally aligned with said tubular housing so as to define an annulus between said tubular housing and said canister;

a channel within said canister, said canister channel being configured to receive the plug therein;

said canister being movable within and along the longitudinal axis of said housing from a bypass-open position to a bypass-closed position;

one or more ports in said canister for permitting fluid to flow through said annulus when said canister is in its bypass-open position, said bypass being substantially shut off when said canister is moved to its bypass-closed position;

a plug-retaining device disposed below said canister, said plug-retaining device selectively movable from a plug-retained position wherein the plug is restricted from exiting said tubular housing, to a plug-released position wherein the plug may exit said tubular housing; and a diverting mechanism that forces said rotational movement of said canister.

39. The plug-dropping container of claim 38 wherein the plug-retaining device also serves as the diverting mechanism; and moving the plug-retaining device from its plug-retained position to its plug-released position also moves the canister from its bypass-closed position to its bypass-open position.

* * * * *